US008118589B2

(12) United States Patent
Haugen et al.

(10) Patent No.: US 8,118,589 B2
(45) Date of Patent: Feb. 21, 2012

(54) COLOR ENHANCEMENT SYSTEM FOR FIRES

(76) Inventors: Sandra Haugen, Papillion, NE (US); Larry Dean Mason, Papillion, NE (US)

( * ) Notice: Subject to any disclaimer, the term of this patent is extended or adjusted under 35 U.S.C. 154(b) by 256 days.

(21) Appl. No.: 12/431,014

(22) Filed: Apr. 28, 2009

(65) Prior Publication Data

US 2009/0269711 A1 Oct. 29, 2009

Related U.S. Application Data

(60) Provisional application No. 61/125,749, filed on Apr. 28, 2008.

(51) Int. Cl.
*F23M 13/00* (2006.01)

(52) U.S. Cl. ..... 431/126; 431/4; 431/125

(58) Field of Classification Search ..... 431/126, 431/4, 125; 44/530, 535, 540, 541
See application file for complete search history.

(56) References Cited

U.S. PATENT DOCUMENTS

| | | | | |
|---|---|---|---|---|
| 2,398,571 | A | 4/1946 | Young | |
| 2,622,017 | A | 12/1952 | Bramhall et al. | |
| 4,062,655 | A | 12/1977 | Brockbank | |
| 4,309,189 | A | 1/1982 | Oberhardt | |
| 4,768,439 | A * | 9/1988 | Singer et al. | 102/336 |
| 6,203,586 | B1 | 3/2001 | Davis | |

* cited by examiner

*Primary Examiner* — Alfred Basichas
(74) *Attorney, Agent, or Firm* — James Ray & Assoc

(57) ABSTRACT

A flame color-enhancing apparatus includes a hollow outer tubular member having a predetermined copper content, a predetermined inside diameter and surface, and a first predetermined length; and an internal tubular member frictionally disposed within the outer tubular member to a predetermined ratio of contact of the interior surface of the outer member to exterior surface of the internal tubular member. The internal tubular member contains a predetermined content of chlorine-based polymer and has a second predetermined length and an outside diameter substantially equal to the predetermined inside diameter.

9 Claims, 2 Drawing Sheets

COLOR ENHANCEMENT SYSTEM FOR FIRES

CROSS REFERENCE TO RELATED APPLICATION

This patent application is related to and claims priority from U.S. Provisional Patent Application Ser. No. 61/125,749 filed Apr. 28, 2008.

FIELD OF THE INVENTION

The present invention relates, in general, to methods for enhancing the appearance of fires and, more particularly, this invention relates to a simple, economical, and partly reusable system for aesthetic enhancement of campfires and fireplaces.

BACKGROUND OF THE INVENTION

People have commonly used wood fires for warmth, but also for adding to the ambiance of their environment at the same time. Wood fires typically give off yellow and orange colors. Various methods have been employed to enhance the coloration of such decorative fires. One method known for many decades is presoaking firewood in a metallic salt solution, and then drying before burning. Brockbank in U.S. Pat. No. 4,062,655 discloses how to make synthetic fire logs impregnated and coated with color-enhancing chemicals.

In another prior art patent example, Bramhall et al in U.S. Pat. No. 2,622,017 teach a fire kindling device that includes a cup containing color-producing salts encased in wax. The preferred chemicals are cupric chloride, strontium chloride, and potassium nitrate, with the potassium nitrate making up less than half by weight to avoid pyrotechnical effects. Similarly, Young in U.S. Pat. No. 2,398,571 discloses additional chemical agents which can be added to slow burning fuel for prolonged coloration.

Oberhardt in U.S. Pat. No. 4,309,189 teaches chemical compound mixtures and methods for producing prolonged coloring of fires. Chloride salts of copper, strontium, potassium, and barium are prominent in Oberhardt's examples. Also taught are methods of containing the chemical powders, such as in packets or bound with wax-like binding agents.

Davis is U.S. Pat. No. 6,203,586 discloses a fire color enhancement system which teaches placing a section of garden hose inside a copper tube which has melting end caps to prevent escape of the garden hose before placement in the fire. Davis mentions plastic and rubber hoses, but says nothing about the need for any chlorine compounds or holes along the copper tube.

SUMMARY OF THE INVENTION

The present invention provides a color-enhancing apparatus for fires which includes a hollow outer tubular member having a predetermined copper content, a predetermined inside diameter and surface, and a first predetermined length; and an internal tubular member frictionally disposed within the outer tubular member to a predetermined ratio of internal area of the outer member to exterior area of the internal tubular member. The internal tubular member contains a predetermined content of chlorine-based polymer and has a second predetermined length and an outside diameter substantially equal to the predetermined inside diameter.

In an alternative embodiment, a pocket member of color-inducing chemical particles is sandwiched between portions of internal tubular members inside the hollow outer tubular member wherein the chemical particles are gradually released to create various colors when exposed to high temperatures common to a fire.

OBJECTS OF THE INVENTION

It is, therefore, one of the primary objects of the present invention to provide a cost-effective method of enhancing the coloration of campfires and wood-burning fireplaces.

Another object of the present invention is to provide a partially reusable apparatus for enhancing the colors in a fire wherein at least a portion can be used multiple times.

Still another object of the present invention is to provide a single color-enhancement unit for campfires that produces colors not normally seen in a fire at multiple locations.

Yet another object of the present invention is to provide a low-cost method for producing copper chloride to be used in-situ for flame color enhancement.

An additional object of the present invention is to provide a campfire color-enhancement system with prolonged functioning once placed into a fire.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
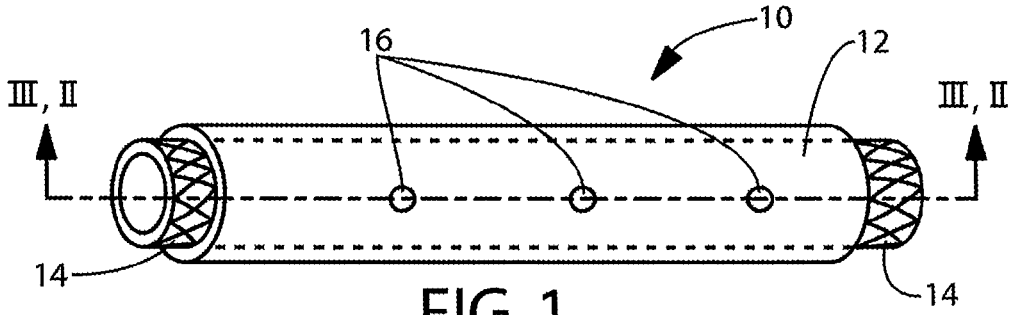
FIG. 1 provides a perspective view of an embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, the present invention is shown generally as 10. An elongated exterior hollow tubular member 12 made of copper or a copper alloy is provided in a first predetermined length, preferably about 4 to 18 inches long, and between one-half and three inches in diameter with four to eight 3/16-inch holes or apertures. The hollow outer member 12 has an internal diameter substantially the same as the outside diameter of a concentric internal tubular member 14 so as to create a frictional fit wherein a substantial portion of the outer surface of the internal tubular member engages the inner surface of the exterior hollow tubular member. The internal tubular member 14 has a second predetermined length preferably slightly longer than the first predetermined length, but optionally the same length. The internal tubular member 14 is at least in part a chlorine-based polymer, preferably flexible polyvinyl chloride (PVC) or combinations thereof, but containing at least 10% chlorine by weight. Preferably, but optionally, the PVC tubular member also contains metallic salt stabilizers, such as barium or cadmium compounds, because some of these may produce other colors when in a flame. A section of a common vinyl garden hose about an inch longer than the outer tube will generally suffice. Preferably, but optionally, a plurality of apertures 16 are spaced axially along the outer tube 12. Also, additional holes or apertures 16 are provided at about 180 degrees from the holes shown. A typical and desirable construction would be six 3/16-inch holes in a 12-inch long copper tube having about a 1-inch inside diameter, and approximately 14 inches of about 1-inch outside diameter vinyl garden hose inside the copper tube. The outer tube could alternatively be one made of a copper alloy having at least 50% by weight copper content. The inner tube need not protrude for both ends, or either end, but preferably the ratio of the internal surface of the hollow outer tubular member in contact with the external surface of the inner tubular member is more than 60%. The outer tube is not necessarily cylindrical, although such is expected to be most cost effective.

Figure 2:
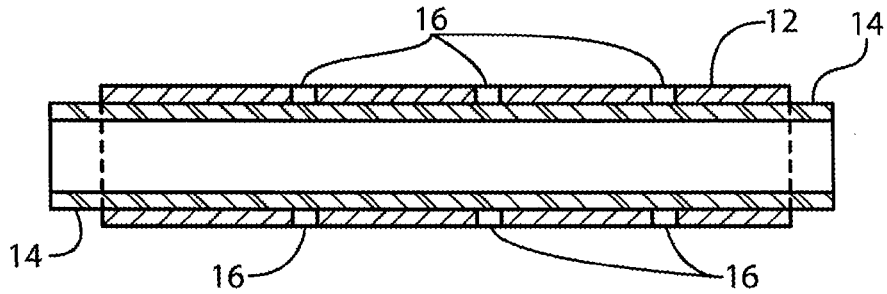
FIG. 2 is a sectional view taken along lines II-II in FIG. 1.
Figure 3:
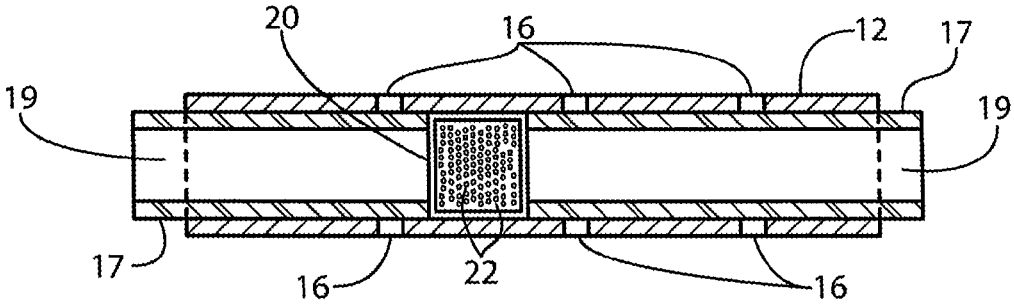
FIG. 3 is a sectional view taken along line III-III in FIG. 1 for an alternative embodiment wherein an internal member is included but not visible in FIG. 1.

FIG. 2 and FIG. 3 are sectional views along lines II-II of FIG. 1. In both, there is the hollow outer copper tubular member 12 with multiple apertures 16, which can be round holes or ones with other shapes. Preferably, but optionally, there is a second row of apertures 16 located about 180 degrees from the first row. These apertures 16 provide additional outlets besides the two open ends 19 for the generated copper chloride gas to escape and impart color in the flames of the fire. In the case of FIG. 2, the internal tubular member 14 is one continuous tube having a length greater than that of the outer tube, and the outside diameter of the inner tube is substantially the same as the inside diameter of the outer tube 12. This is an important feature because the frictional fit is all that is needed to hold the two members 12 and 14 together, and it provides intimate contact of the two tubes so that the desired chemical reaction can proceed at the elevated temperatures of the fire. The ratio of substantial contact of the inner tube outside surface to the hollow outer tube inside surface area is greater than 60 percent. The alternative embodiment depicted in FIG. 3 provides a simple arrangement for providing additional color enhancement by sandwiching a pocket member 20 encasing chemical particles 22 between two portions 17 of the internal tube inside the elongated outer tube 12. The pocket 20 could be of a material, typically polyethylene or flexible PVC, that would melt or disintegrate in a fire and gradually release the chemicals into the fire. The additional chemicals would extend the range of colors visible and the length of time present. Alternatively, the pocket 20 could be a wax plug with chemicals imbedded throughout. The teachings of Bramhall et al are incorporated herein by reference. It is important to keep the two open ends 19 unobstructed so that evolved gases can readily escape.

Figure 4:
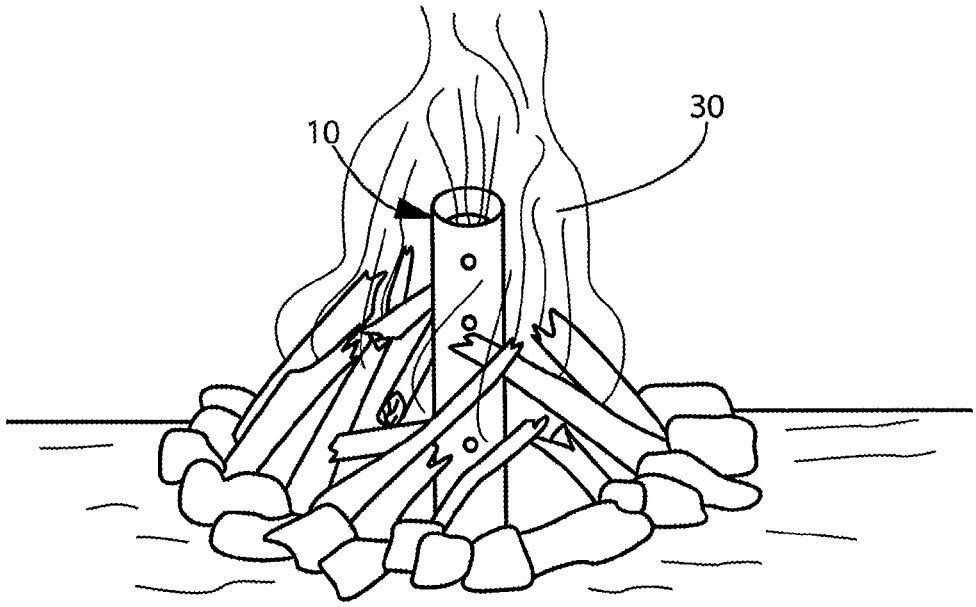
FIG. 4 is a perspective view of the present invention being used in a campfire.

FIG. 4 illustrates one way in which the present invention 10 could be deployed in a campfire 30. After sufficient heating by the fire, blue-green and purple coloration of the fire will be seen near the two ends of the apparatus 10 and in the vicinity of the side apertures. After the fire has cooled sufficiently, the copper tube can be retrieved and it can be refilled with a section of PVC garden hose unless too much of the copper has been consumed. In addition, a new pocket or wax plug of chemicals could be added before inserting two hose sections. The garden hose member could also be a PVC-rubber blend.

Figure 5:
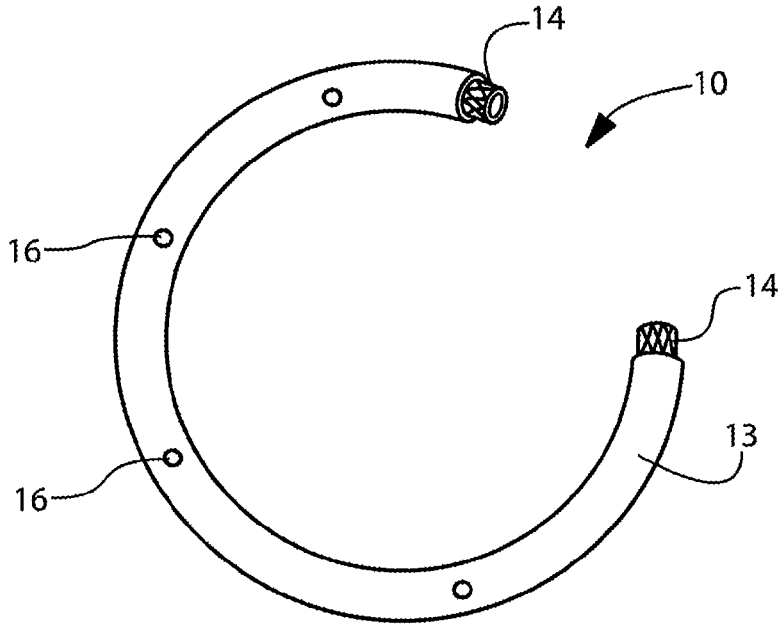
FIG. 5 provides a perspective view of an alternative configuration of the present invention.

FIG. 5 provides a perspective view of the present invention 10 in an alternative embodiment in which the elongated copper hollow outer tubular member 13 is in a shape other than a straight tube. It could be semi-circular or a partial ring as shown, and up to 30 inches in overall length. The arcuate tubular member 13 must have a smooth continuous internal pathway to enable the inner flexible PVC tube or hose 14 to be inserted. This shape matches better to the conical nature of campfires and would provide color more uniformly throughout the fire with the aid of the apertures 16.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A flame color-enhancing apparatus comprising:

a) an elongated outer tubular member having a predetermined copper content, a predetermined inside diameter and an internal surface, and a first predetermined length wherein said outer tubular member contains a plurality of axially spaced apertures; and b) an internal tubular member with a second predetermined length, an external surface, and a predetermined outside diameter disposed within said outer tubular member wherein said internal tubular member has a predetermined content of chlorine-based polymer and said outside diameter is substantially equal to said predetermined inside diameter such that at least a portion of said internal surface engages with at least a portion of said external surface having a frictional fit.

2. The flame color-enhancing apparatus according to claim 1, wherein said predetermined internal diameter is between about one-half and three inches.

3. The flame color-enhancing apparatus according to claim 1, wherein said first predetermined length is between about 4 and 30 inches.

4. The flame color-enhancing apparatus according to claim 1, wherein said predetermined content of said chlorine-based polymer provides at least 10 weight percent chlorine.

5. The flame color-enhancing apparatus according to claim 1, wherein said chlorine-based polymer is a plasticized polyvinyl chloride.

6. The flame color-enhancing apparatus according to claim 1, wherein said hollow outer tubular member is one of linear and arcuate.

7. The flame color-enhancing apparatus according to claim 1, wherein a ratio of said internal surface of said hollow outer tubular member to said external surface of said internal tubular member is at least 60%.

8. The flame color-enhancing apparatus according to claim 1, wherein said predetermined copper content is at least 50%.

9. The flame color-enhancing apparatus according to claim 1, wherein said internal tubular member further houses a pocket member encasing chemical particles.

* * * * *